United States Patent [19]

Bolli et al.

[11] Patent Number: 4,861,306

[45] Date of Patent: Aug. 29, 1989

[54] TOY COG RAILWAY

[75] Inventors: Peter Bolli, Steinhausen; Heniz Looser; Werner Tanner, both of Baar, all of Switzerland

[73] Assignee: Interlego A.G., Baar, Switzerland

[21] Appl. No.: 74,533

[22] Filed: Jul. 16, 1987

[30] Foreign Application Priority Data

Jul. 21, 1986 [CH] Switzerland ..... 2901/86

[51] Int. Cl.[4] ..... A63H 33/04; A63H 17/00; A63H 18/14

[52] U.S. Cl. ..... 446/90; 446/96; 446/445

[58] Field of Search ..... 446/88, 90, 91, 93, 446/94, 95, 96, 448, 447, 446, 445, 468, 467, 466, 465; 105/1.5, 3, 4.1, 4.2, 199, 157.2; 104/118, 120, DIG. 1; 238/10 R, 10 A, 10 E

[56] References Cited

U.S. PATENT DOCUMENTS

| | | | |
|---|---|---|---|
| 719,339 | 1/1903 | Kester | 446/447 |
| 1,997,512 | 4/1935 | Einfalt | 446/444 |
| 2,019,690 | 11/1935 | McKeige | 446/467 |
| 3,143,977 | 8/1964 | Deller | 105/4.1 |
| 3,224,135 | 12/1965 | Wright et al. | 446/95 |
| 3,354,836 | 11/1967 | Willison | 105/3 |
| 3,570,177 | 3/1971 | Tomaro | 104/118 |
| 3,589,064 | 6/1971 | Harada | 446/445 |
| 4,556,393 | 12/1985 | Bolli | 446/91 |

FOREIGN PATENT DOCUMENTS

| | | | |
|---|---|---|---|
| 3536891 | 4/1986 | Fed. Rep. of Germany | 446/467 |
| 2029249 | 3/1980 | United Kingdom | 446/467 |

*Primary Examiner*—Richard J. Johnson
*Assistant Examiner*—Michael Brown
*Attorney, Agent, or Firm*—Kane, Dalsimer, Sullivan, Kurucz, Levy, Eisele and Richard

[57] ABSTRACT

A toy cog wheel railway is provided having a track with smooth driving faces and a center cogging member with two opposed vertically extending racks thereon. The associated train has an engine with a driven chassis and further cars with undriven running chassis. The chassis contain wheels with smooth faces to run on the driving faces of the track. The undersides of the chassis are provided with opposed guide members that contact the opposed sides of the cogging member. The driven chassis is provided with a motor whose drive axis is vertical with respect to the driving faces of the track and is offset with respect to the center line between the guide members so that a cogwheel attached to the drive axle engages only one of the racks. The chassis are further provided with coupling arm including a yoke having two deflected arms which are pivotally mounted to the chassis at a height approximate that of the drive motor cogwheel and the guide members, respectively, and in the longitudinal direction approximate that of a vertical plane containing the center of gravity of the respective chassis.

31 Claims, 12 Drawing Sheets

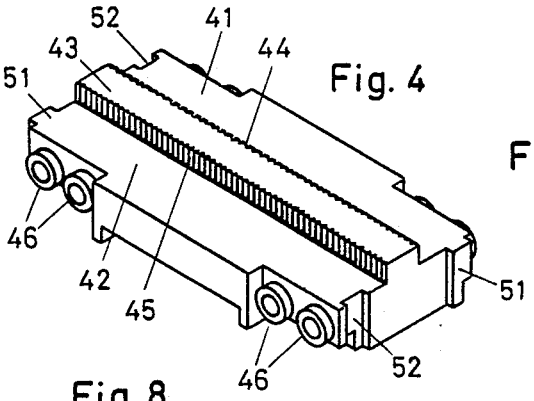
Fig. 4
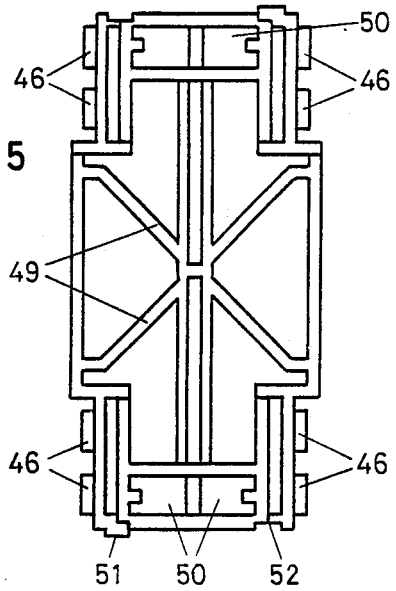
Fig. 5
Fig. 8
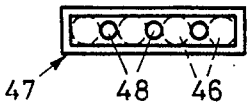
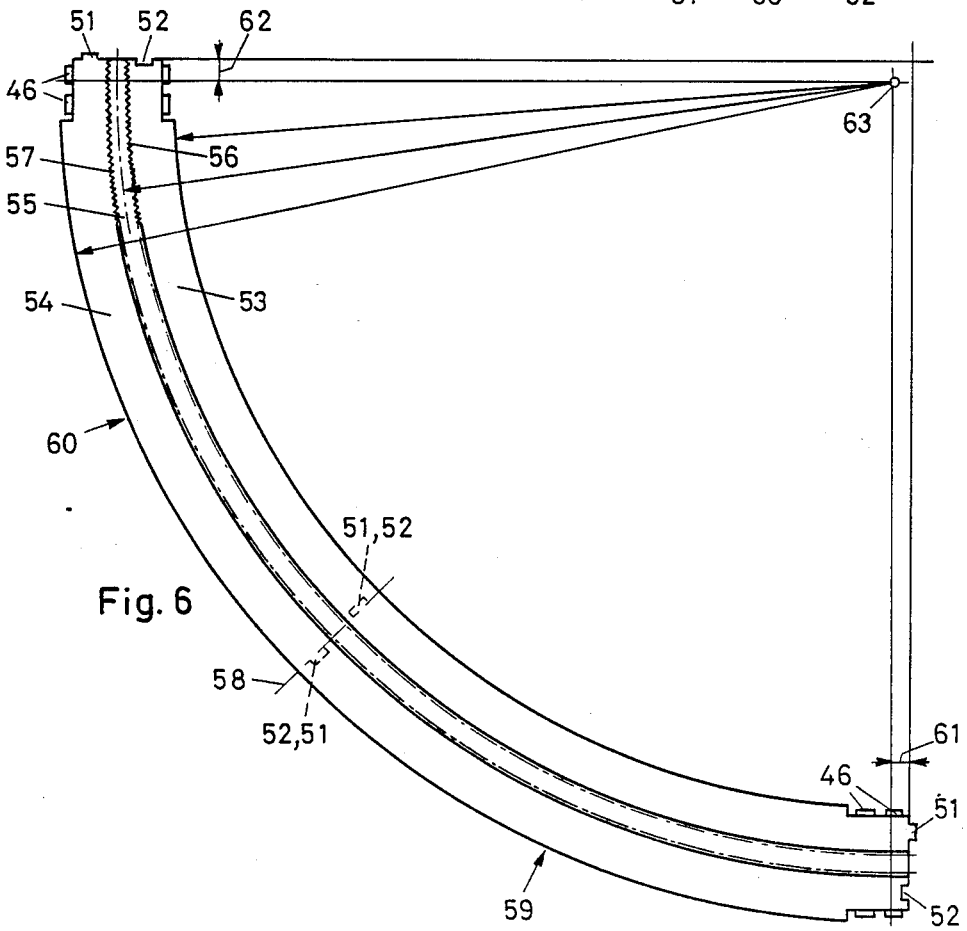
Fig. 6

100
101
92
135
136
12
98
99
94
131
93
102
115
113
114
116
111a
111b
111c
111d
110
112
87
89
97
96
95
134
103
124
127
117
118
119
120
121
122
123
125
126
128
129

127
103
124
92
105
104
112
96
138
142
88
105
92
96
128
127
129
126
125
124
123
121
122
103
119
118
120
94
92
105
135
12
136
141
135
136
143
140
139
12
142
136
105
135
12
94
131
12
111d
112
111c
104
111e
111b
12
112
111a
131
12
94

TOY COG RAILWAY

BACKGROUND OF THE INVENTION

The present invention relates to toy railways and in particular to a toy cog railway.

Cog railways are used on steep slopes where static friction alone may not be sufficient to overcome gravity. Toy cog railways have heretofore been constructed as small scale versions of actual cog railways. Accordingly, the track for the railway has been provided with a center rack between two rails. The associated train includes a cog wheel that is driven by an electromotor of the train engine to engage the rack. Actual cog railways may employ one of several systems (e.g. Riggenbach, Abt, Strub, and Locher) although toy cog railways usually employ the Strub system which utilizes upper open cogs since this simplifies the manufacture of the rack as well as the engine.

In order to make toy cog railways realistic heretofore the manufacturing costs were relatively high and the products were not particularly robust. As a result such toys were not particularly well suited for young children who lack technical understanding of the toy but wish to operate the model railway over tight turns and steep slopes.

Model cog railways heretofore available also suffer from a shortcoming of actual cog railways in that the maximum steepness of the track slope is relatively small particularly on tight turns. In addition, only by providing a relatively heavy engine and a relatively light trailer load can the engine be prevented from "lifting" off the rack. Further, model cog railway's can only be used to a very limited extent for "pushing" since the pushed cars tend to leave the track particularly on steep slopes and tight turns.

In U.S. Pat. No. 4,547,710 there is disclosed a toy comprising a vehicle in the form of an imaginary animal figure designed to travel on a horizontal, substantially smooth track mounted on a support. The track is in the form of an approximate oval formed of two parallel side sections and curved end sections. The track has a vertical cogging rack throughout its entire length on its inner edge which is engaged by a battery driven cogwheel. The vehicle moves in one direction along the straight sections of track and reverses direction in the curved end section. The vehicle is guided along the track by a shoe that rides in a recess of the track between the rack and outer track edge.

A toy that operates with a somewhat similar movement is also disclosed in French patent 517,106. This toy is also provided with a closed approximately oval track with a vertically extending rack on the track inner face. A vehicle that moves along the track is provided with a drive motor and a drive cog that engages the rack and which is so constructed that that as it moves it also rotates two airplane models mounted on two cantilevers.

In contrast two the prior art, it is an object of the present invention to provide an model cog railway which is a realistic model of actual cog railways.

A further object is to provide such an model cog railway wherein the track may readily and easily be laid out in any desired shape without any particular skill or expertise.

A still further object is to provide such an model cog railway which can operate in both pushing and pulling modes.

SUMMARY OF THE INVENTION

The above and other beneficial objects and advantages are attained in accordance with the present invention by providing a model cog railway comprising a model track and model engine. The track comprises a smooth driving face on which a cog member extends longitudinally. The cog member is provided with two transversely separated racks of vertically extending cogs symmetrically disposed with respect to the drive face.

The engine is provided with a pair of guides positioned opposite each other to engage one each of the track racks. The engine is further provided with a drive motor having a single drive cog wheel which is offset with respect to the center of the separation between the guides so as to engage one or the other of said track racks With the above construction a very high degree of stability of the engine on the track is attained so that derailings on tight curves and along winding slopes is practically eliminated even when the engine is moving at relatively high speeds. Since the racks extend laterally and vertically with respect to the driving face of the track, the engagement of the cogs of the rack by the cog wheel enables the engine to overcome steep slopes without danger of the cog wheel disengaging from the rack. Further, the one sided engagement of the cog wheel with either of the racks facilitates mounting the engine onto the track. As a result of the above, any configuration track with slopes and curves may readily be laid out without any particular expertise.

Coupling devices are also be provided between the engine and nondriven cars to prevent such cars from derailing on steep slopes or curves. These devices serve to apply the moving force for the cars as close as possible to the driving face of the track and center of gravity of the car.

BRIEF DESCRIPTION OF THE DRAWINGS

In the accompanying drawings:

FIG. 4 is a section of straight track for the present model cog railway;

FIG. 5 is a bottom plan view of the track section of FIG. 4;

FIG. 6 is a top plan view of a section of track with a 90° curve;

FIG. 8 is a bottom plan view of a flange for connecting the track sections of FIGS. 4 and 6;

DETAILED DESCRIPTION OF THE PREFERRED EMBODIMENTS

Figure 1:
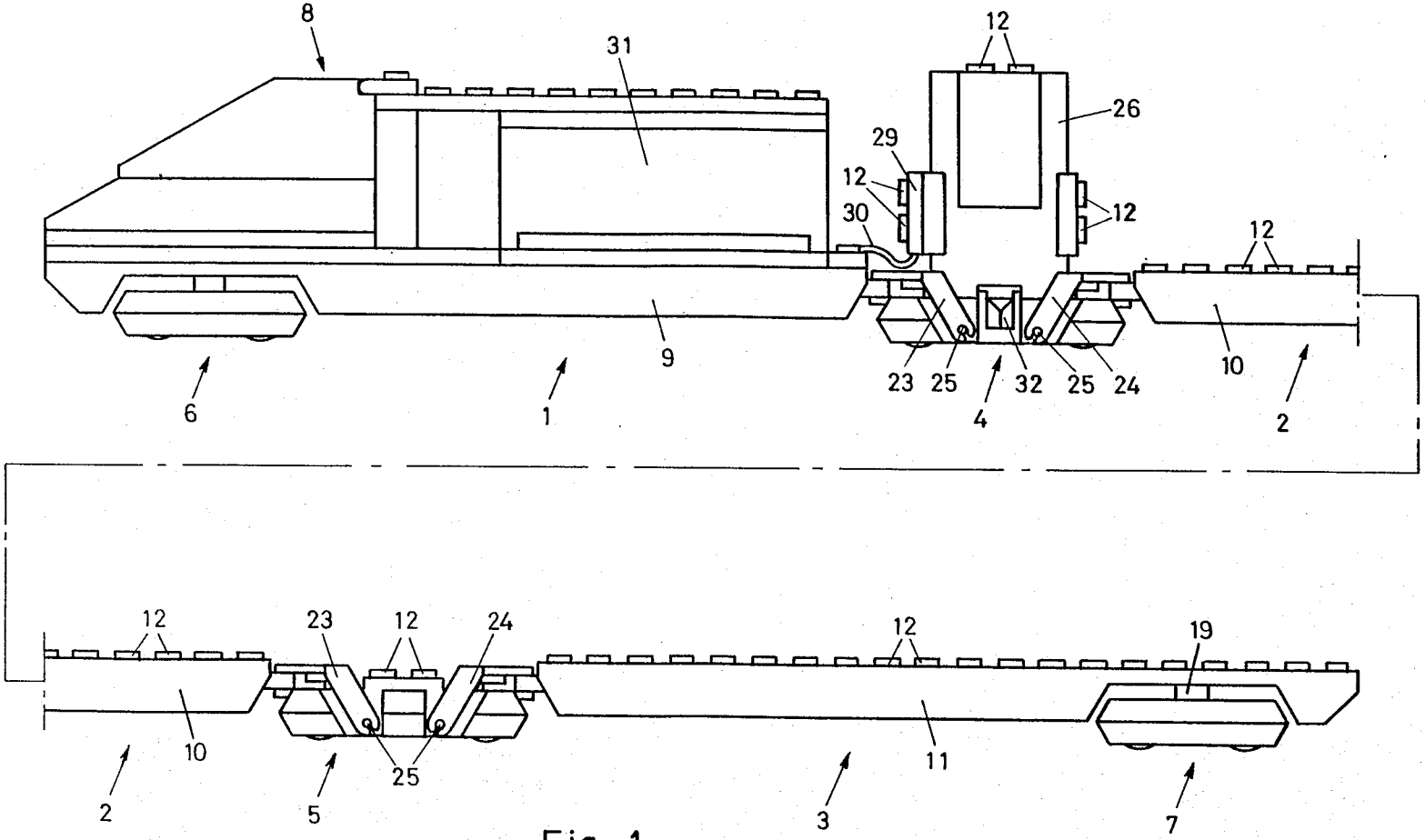
FIG. 1 is a side elevational view of a model train in accordance with the present invention which is formed of building blocks and is provided with a cog wheel.
Figure 2:
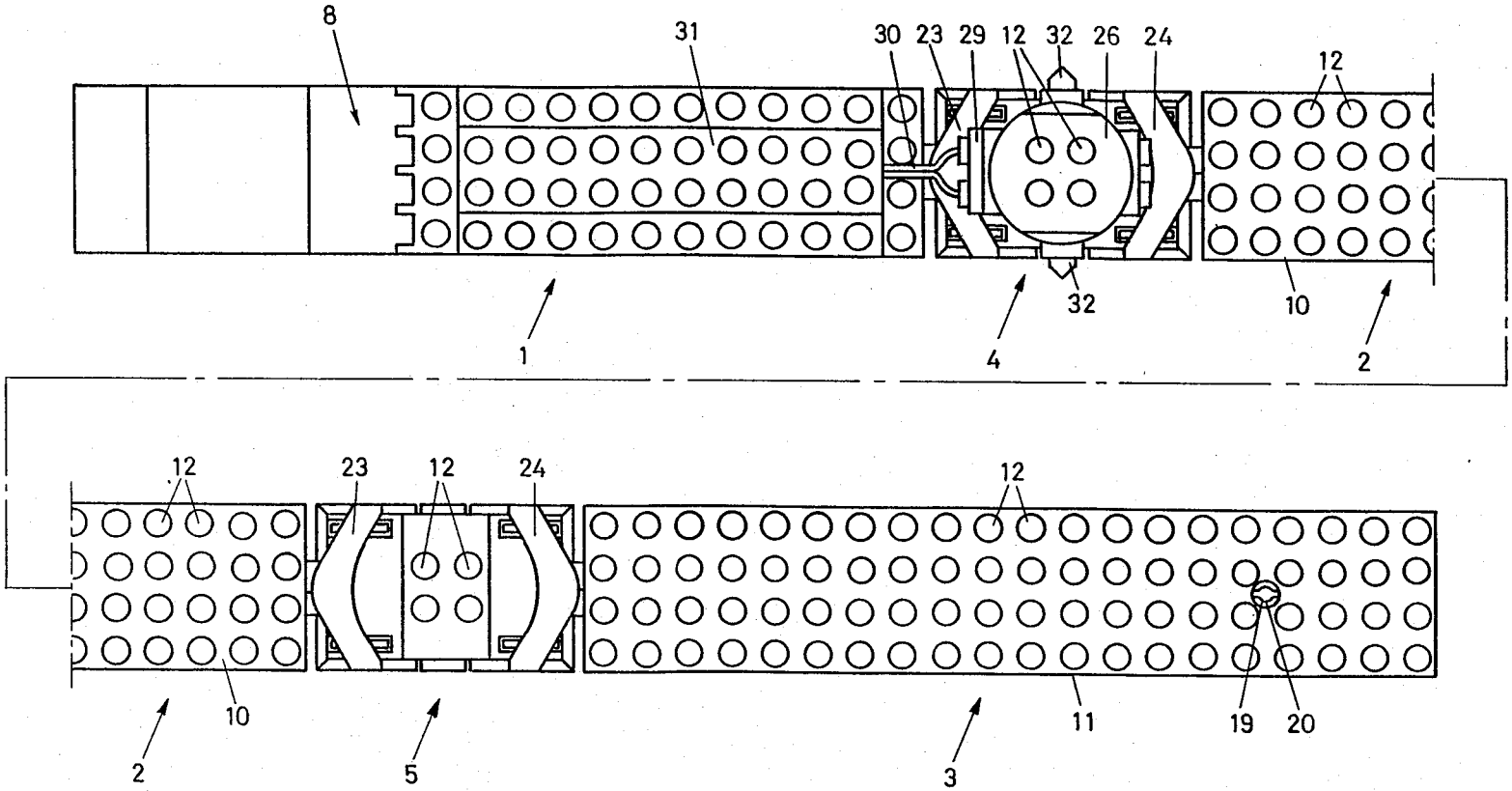
FIG. 2 is a top plan view of the train of FIG. 1.
Figure 3:
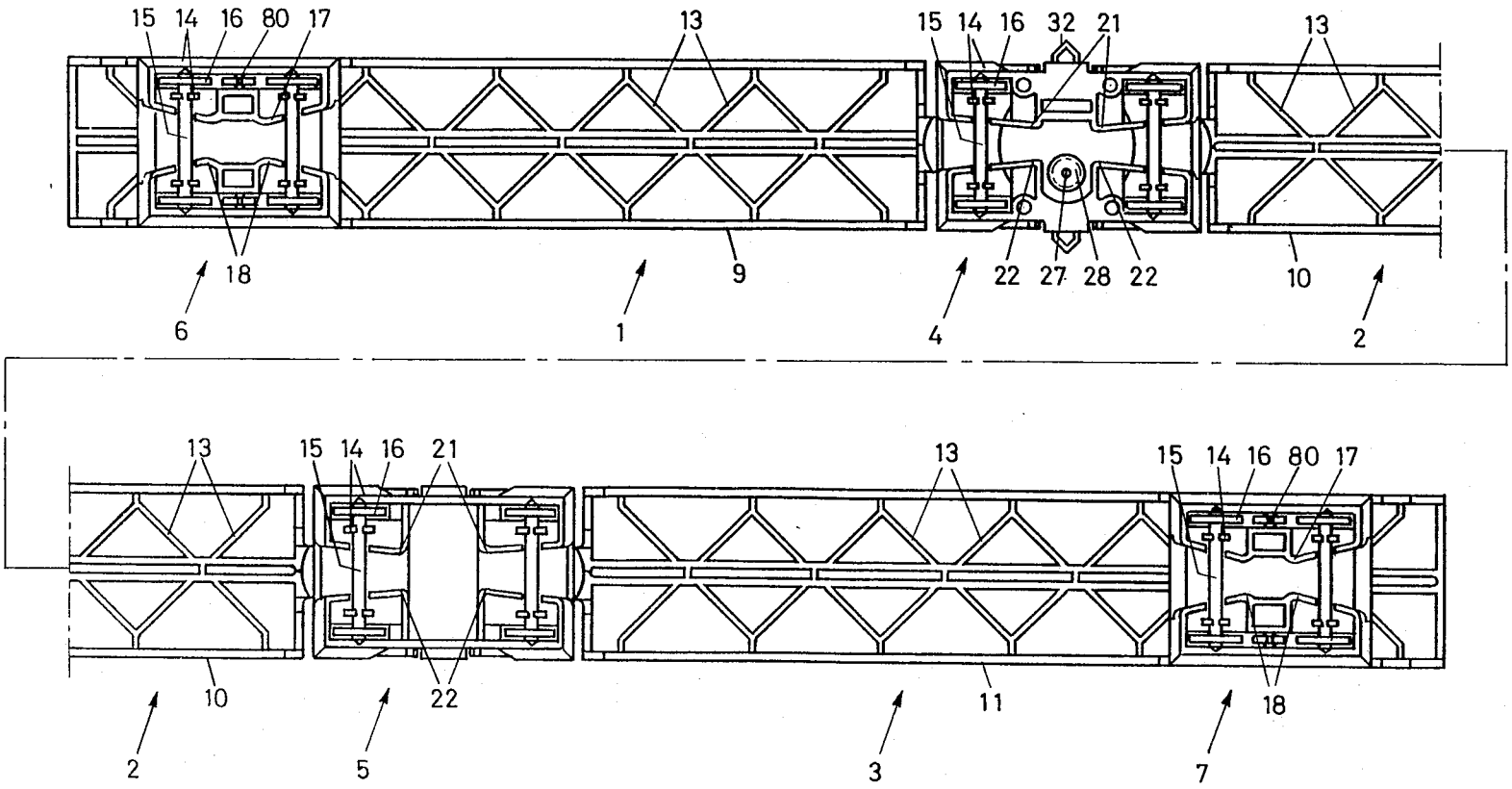
FIG. 3 is a bottom plan view of the train of FIG. 1.

Reference is now made to the drawings and to FIGS. 1–3 in particular wherein a model train in accordance with the present invention is depicted. The train is formed of building blocks and comprises a head or control car 1, an intermediate car 2, and an end car 3. The head car 1 is connected to the intermediate car 2 through a coupling chassis 4 and the intermediate car 2 is connected to the end car 3 through a coupling chassis 5. The front of the head car 1 and the rear of the end car 3 are provided with pivoted bogies 6 and 7, respectively. It should be appreciated that the intermediate and end cars 2, 3 could be provided with appropriate car bodies through a car body 8 mounted onto a platform 9 is shown only for head car 1. Thus, if desired, walls, doors, windows, etc. could be built from blocks onto the platforms 10, 11 of cars 2, 3. To this end, the platforms 9, 10, 11 are provided with coupling pins 12 to which blocks (such as those sold under the well known LEGO trademark) may be connected The undersides of the platforms 9, 10, 11 of cars 1, 2, 3, respectively, are hollow and reinforced with ribs 13 as shown in FIG. 3.

The couples chassis 4 and 5 as well as the pivoted bogies 6 and 7 are formed of a synthetic plastic material except for the wheel axles and the coupling or mounting elements. As shown in FIG. 3, the undersides of the pivoted bogies 6 and 7 are generally hollow and provided with extended axle mounting clamps 14 for receiving wheel axles 15. Each of the axles 15 is provided at its ends with a turning wheel 16, the face of which is smooth. The pivoted bogies 6, 7 are provided with a pair of longitudinally extending opposed walls 17, 18. These walls serve as guides for the bogies on a track provided with a rack as will be explained below. The pivoted bogies 6, 7 are further provided with a pivot 19 (see FIG. 1) which is fixedly positioned in a hole 20 (see FIG. 2) of the associated platform 9 or 11. Further details of this arrangement will be discussed forthwith in connection with FIGS. 16 and 17.

The underside of chassis 5 is similar to that of the pivoted bogies 6 and 7 and shown in FIG. 3. Thus, it too is provided with extended mountings 14 wherein the wheel axles 15 for wheels 16 are received. In addition, it also contains longitudinally extending opposed guide walls 21 and 22. The upper face of chassis 5 is provided with pivotal coupling yokes 23 and 24 which pivot about lateral pins 25. The coupling yokes 23, 24 serve to detachably receive corresponding coupling elements at the ends of platforms 10, 11. The details of the coupling means will be explained in further detail forthwith in connection with FIGS. 12–15 and FIGS. 19–21. The upper face of chassis 5 is provided with coupling pins 12 to which structures may be coupled if desired.

The underside of chassis 4 is basically the same as that of chassis 5 as may be seen from FIG. 3 and includes axle mounting clamps 14, axles 15 and wheels 16 as well as guide walls 21 and 22 as previously described. However, since chassis 4 is a driving chassis it further includes a substantially cylindrical electromotor 26 which is mounted in the vertical position as shown in FIGS. 1 and 2. The motor has a vertical drive axle 27 (FIG. 3) offset from the center line of the chassis which supports a cog 28 and which preferably is driven by motor 26 via a gearing (not shown). Cog 28 is mounted in the underside of the chassis proximal guide wall 22. As will be described, cog 28 is designed to engage the rack of an associated track and serves to move chassis 4 and hence the entire train when the electromotor 26 is excited. The electromotor 26 is also provided with coupling pins 12.

The electromotor 26 is electrically fed via a plug 29 formed as a building block along with an associated feed cable 30 to a battery box 31 mounted in the head car 1 as shown. A slide switch 32 (FIG. 2) controls the connection between the battery box 31 and the electromotor 26 and has "OFF", forward and reverse positions. The switch extends slightly beyond chassis 4 and has beveled faces on its ends as shown. These faces may coact with pins or the like provided on an associated track to engage the switch as the train passes to thereby stop the train or reverse its direction. Similarly an infrared or other type of remote control element could be provided in the head car or one of the other cars to allow continuous control. The chassis 4 and 5 are provided with two coupling yokes 23, 24 to permit detachable connection with the head car 1 or the platform 10 of intermediate car 2.

Figure 7:
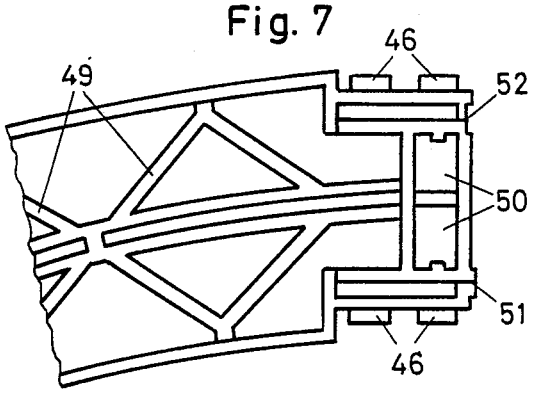
FIG. 7 is a bottom plan view of the ends of the track section of FIG. 6.

The toy cog railway of the present invention further includes a a track with appropriate rack members with which the cogwheel of train engages. Preferred embodiments of a straight section of such track is depicted in FIGS. 4 and 5. A curved section of track is depicted in FIGS. 6 and 7. It should be realized at the outset that the straight section of track may be of any desired length although a standard size is preferred. The track includes on its top face two smooth longitudinally extending drive surfaces 41 and 42 which are separated by a somewhat raised, central section 43. The central section 43 is provided with racks 44, 45 on its opposed walls which are disposed vertically with respect to the drive surfaces 41, 42. Laterally extending coupling pins 46 are provided in recessed at each end of the track section to permit connection to another length of track by means of a coupling flange 47 as shown in FIG. 8. The coupling flange 47 is provided with coupling pins 48 that engage the pins 46 in a clamping manner as shown in FIG. 8.

As shown in FIG. 5 the underside of the track section is generally hollow and reinforced by ribs 49. A box-like opening 50 at each end of the track section permits the section to be inserted into a base member or building plate having coupling pins in the proper raster.

It can also be seen from FIG. 4 that the front of the drive surfaces 41, 42 are recessed (as at 52) or extended (as at 51) to facilitate the coupling of two sections of track and to relieve the stress on coupling flange 47. The protrussion 51 and recess 52 also serve to code the track as will be further described.

The curved track of FIG. 6 is also provided with two drive faces 53 and 54 separated by a center section 55 that is provided with opposite racks 56 and 57. The ends of the curved track are also provided with lateral coupling pins 46 and protrussions 51 and recesses 52 on its end faces as describe above. As can be seen in FIG. 7 the underside of the curved section is similar to that of the straight section and includes the box-like cavities 50 for coupling to the appropriate pins of a base plate. In this regard it should be noted that it is impossible to have the circular track section exactly engage the coupling pins of a base plate raster unless the sections extend about 90°. However, an arrangement to permit such coupling has heretofore been disclosed in Swiss patent application 7981/86 (which corresponds to U.S. patent application Ser. No. 018,705 filed Feb. 25, 1987 for TRACK SYSTEM FOR TOY VEHICLES). Thus, the 90° section of track of FIG. 6 may be formed of two 45° sections 59, 60 separated along line 58. Each of these sections is composed of arcuate segment 58, 59 and a substantially shorter straight segment 61, 62. FIG. 6 also illustrates the inner and outer radii of the track as well as the center radius of the rack 55 which all eminate from the displaced center point 63. Since the 45° segments 59, 61 and 60, 62 need not be identical their ends are provided with different codings as indicated in FIG. 6 at radial line 58.

The aforementioned patent application also discloses the appropriate dimensions for sloped track segments and other arrangements that are to be coupled to a base plate raster of coupling pins.

Figure 9:
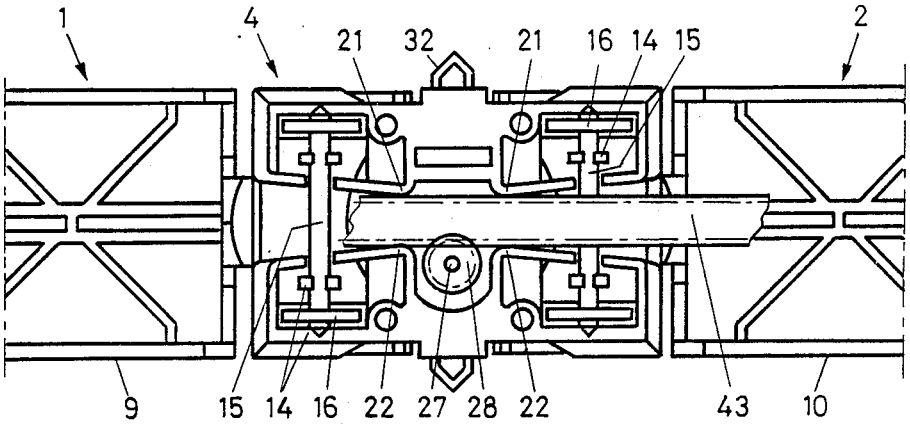
FIG. 9 is a bottom plan of the coupled drive chassis of FIG. 3 depicted with a rack.
Figure 10:
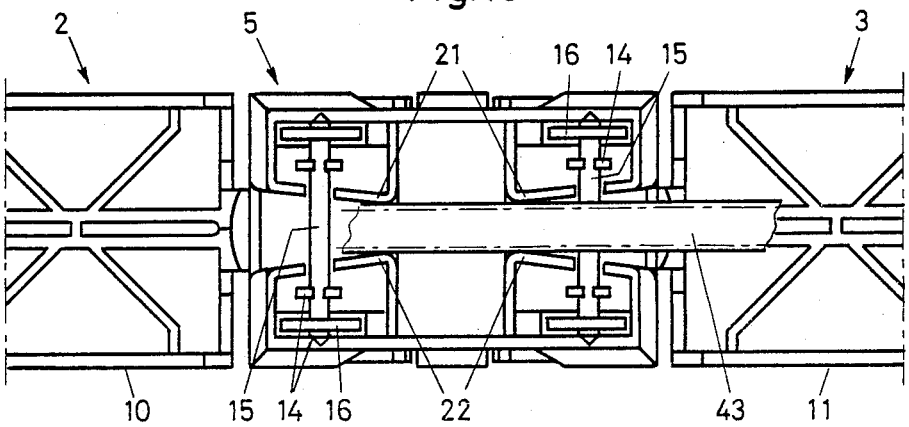
FIG. 10 is a bottom plan view of the coupled intermediary chassis of FIG. 3 depicted with a rack.
Figure 11:
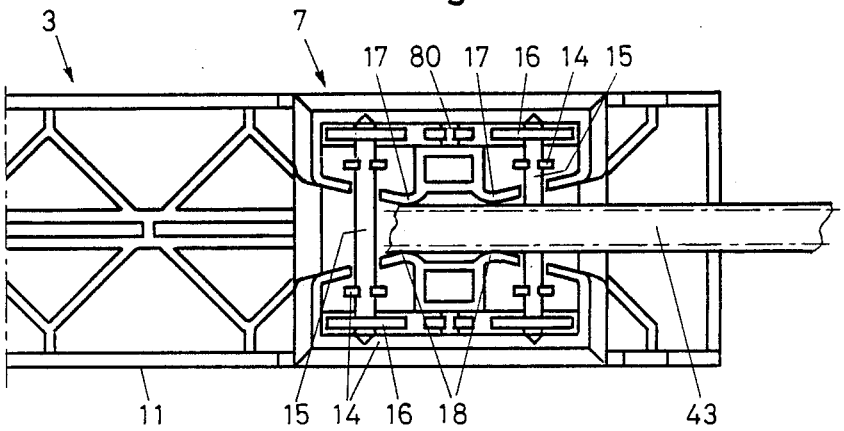
FIG. 11 is a bottom plan view of the coupled end chassis of FIG. 3 depicted with a rack.

FIGS. 9–11 illustrate the undersides of chassis 4 and 5 and the pivoted bogie 7 in conjunction with the rack 43 of a straight section of track. It can be seen that the guide walls 21, 22 (of chassis 4, 5) and 17, 18 (of bogie 7) contact the rack 43 on both sides thereof and that the cogwheel 28 engages one side of the rack 43 only.

Figure 12:
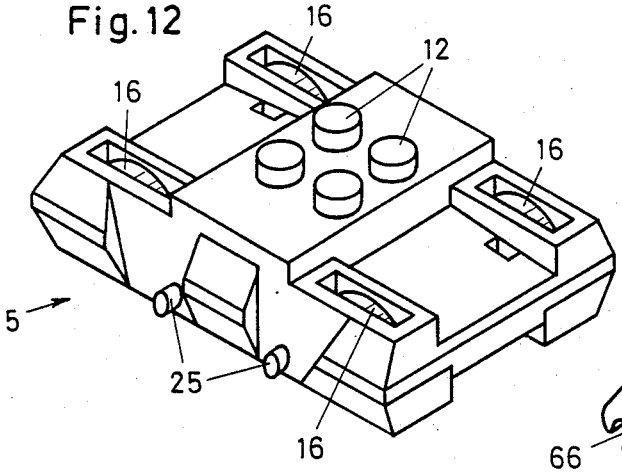
FIG. 12 is a perspective view of an uncoupled intermediate chassis.
Figure 13:
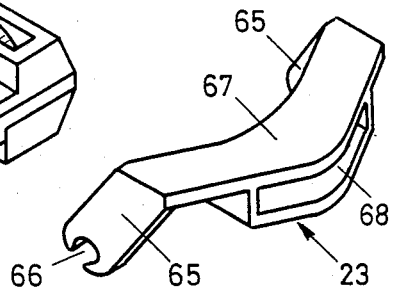
FIG. 13 is a perspective view of a coupling yoke for the chassis of FIG. 12.
Figure 14:
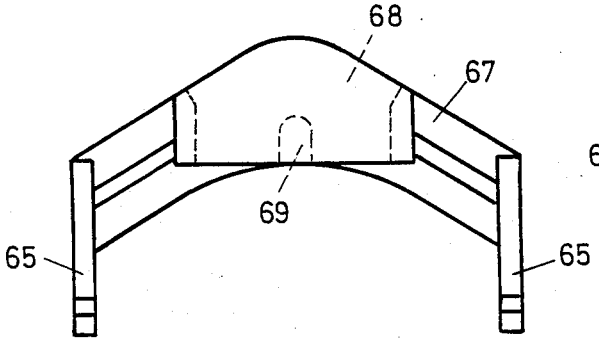
FIG. 14 is a top plan view of the coupling yoke of FIG. 13.
Figure 15:
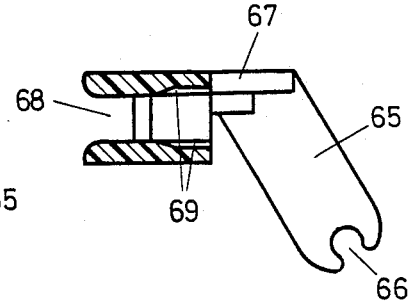
FIG. 15 is a sectional view through the coupling yoke of FIG. 13.

FIG. 12 is a perspective view of the running chassis 5 of FIGS. 1–3. From FIGS. 13–15 it can be seen that the coupling yoke 23 has two deflected arms 65 each of which is provided with a clamping slot 66 at its ends. The clamping slot serves to engage the laterally extended pins 25 of chassis 5 as shown in FIG. 1. The center part 67 of the yoke 23 is provided with a slot 68 the inner ends of which are provided with a grooved recess 69 (see FIG. 15). The slot 68 serves to receive a complementary tongue 70,71 mounted to the ends of the car platforms 9, 10, and 11. Thus, referring to FIGS. 18–21 it can be seen that the extended tongues 70, 71 at opposite ends of the platform 10 are provided at their outer edges with upper and lower locking buttons 72. When a tongue 70, 71 is inserted into slot 68 of the coupling yoke 23 the locking buttons push apart the upper and lower slot walls and then pass into the grooved recess 69 so that the tongues are locked in position. The cars may be decoupled by simply pulling the platform 10 off the coupling yoke 23.

Figure 21:
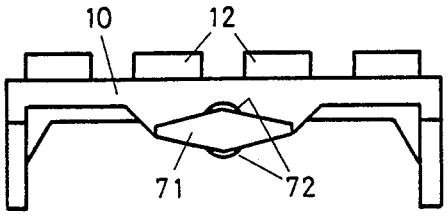
FIG. 21 is a front elevational view of the other end on the car platform of FIG. 18.
Figure 20:
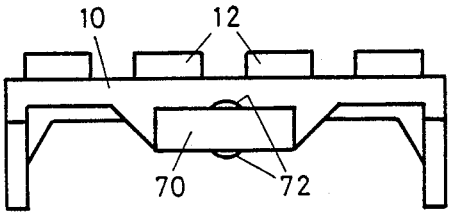
FIG. 20 is a front elevational view of one end on the car platform of FIG. 18.

It can be seen from FIGS. 20 and 21 that the tongue 70 at one end of platform 10 is provided with a different cross-sectional shape than the tongue 71 at the opposite end of platform 10. Thus tongue 70 which is rectangular in cross-section provides a rigid connection in slot 68 whereas tongue 71 which is rhombus-shaped permits some slight reciprocal movement within slot 68. It has been found that if all the tongues were shaped as tongue 70 the cars of the model train would tend to lift off the track on tight turns particularly on steep slopes. On the other hand if all of the tongues were shaped as tongue 71 the train cars would run unsteady at any speed. Thus it is advantageous to use both style tongues 70, 71 which can both be received in slot 68 of the coupling yoke 23.

It has also been found that the force transmission engagement points between a chassis and a car should be vertically disposed with respect to the track and the car as those elements that part in the force transmission (i.e. the cogwheel of the drive motor and the drive face of the track). Thus the coupling yokes 23, 24 are pivoted on the chassis 4,5 as low as possible and as close as possible to the driving faces 41, 42. Accordingly the lateral pins 25 of chassis 4, 5 are positioned relatively low. In addition, the the engagement points should be as close to each other as possible in the plane perpendicular to the longitudinal direction of the train that contains the center of gravity of the chassis. In chassis 4 and 5 this plane is disposed in the center of the chassis. Thus the pins 25 (FIG. 1) for coupling yokes 23, 24 are positioned close to the chassis centers and the coupling yokes 23, 24 are provided with unusually long inclined arms 65 (FIG. 15) which permit coupling of the platforms at the ends of the chassis. The pivot mounting of the coupling yokes 23, 24 thus provides that all forces transmitted from the chassis 4, 5 to the platforms 9, 10, 11 have a main component parallel to the track and a substantially smaller vertical component. As a result, the moment that would tend to lift the chassis and cars off the track when the train is operating is negligible. The cog railway is thus extremely stable even if the track is freely suspended without support posts and laid out with steep slopes and tight curves. The angle of inclination of the track is limited essentially only to the angle wherein the vertical plane through the center of gravity of a chassis extends through the contact points of the corresponding wheel axles of the wheels mounted on the track. In practice, this corresponds to a slope of greater than 100°. This is true whether the engine is pulling or pushing the other cars.

Figure 16:
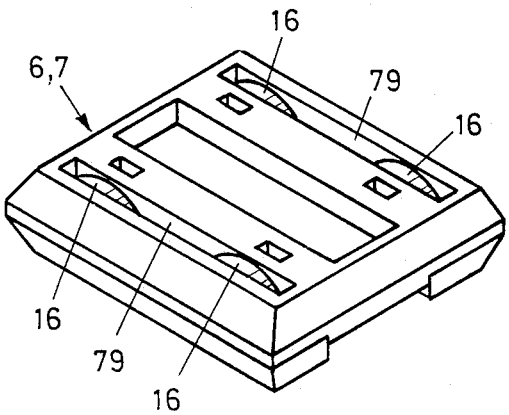
FIG. 16 is a perspective view of the uncoupled end chassis of FIGS. 1 to 3.
Figure 17:
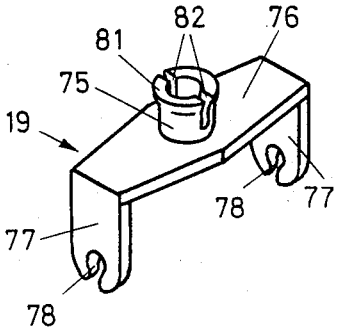
FIG. 17 is a perspective view of a connecting yoke for the chassis of FIG. 16.
Figure 18:
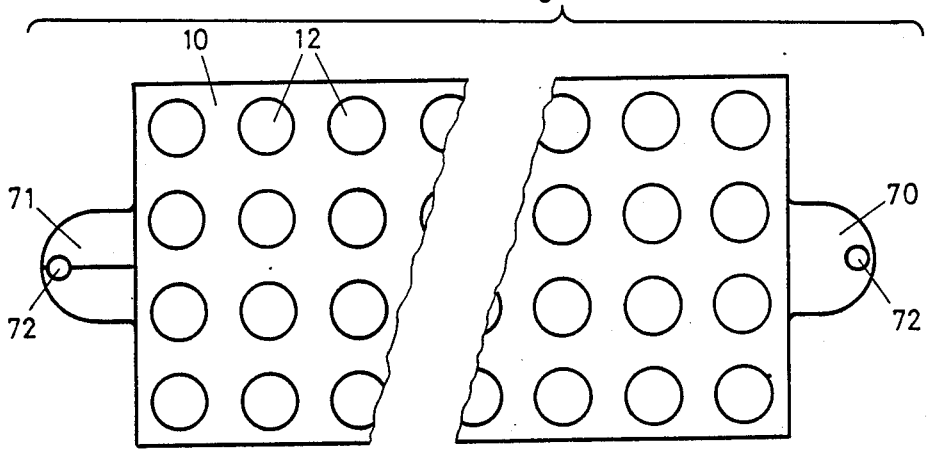
FIG. 18 is a top plan view of a platform for a car of the train of FIGS. 1 to 3.
Figure 19:
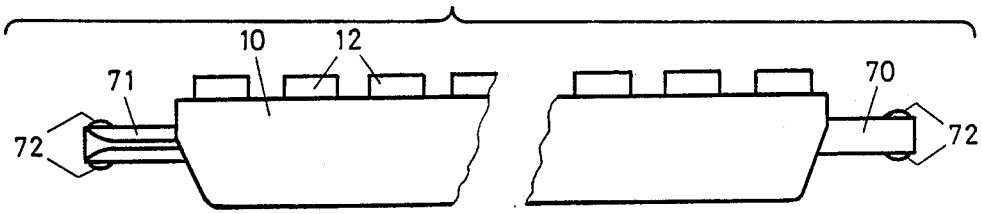
FIG. 19 is a side elevational view of the car platform of FIG. 18.

FIG. 16 illustrates the pivoted bogies 6, 7. In FIG. 17 a pivoting element 19 for mounting the pivoted bogies 6,7 to the platforms 9 and 11 is illustrated. Thus, the pivoting element 19 is provided with a cylindrical pin element 75 which is mounted on a support yoke 76. The support yoke 76 has two arms 77 provided with clamping slots 78. Arms 77 are designed to be inserted through slots 79 of the pivoted bogies 6, 7 and then clamped onto mounting ribs 80 of the pivoted bogies 6, 7 as shown in FIG. 3. The pin element 75 is provided with a shoulder 81 through which a pair of slots 82 extend longitudinally. These slots serve to render the shoulder somewhat flexible so that the pivoted bogies 6,7 may be detachably but rigidly inserted into the hole 20 provided in platform 9,11 in a simple manner.

Figure 22:
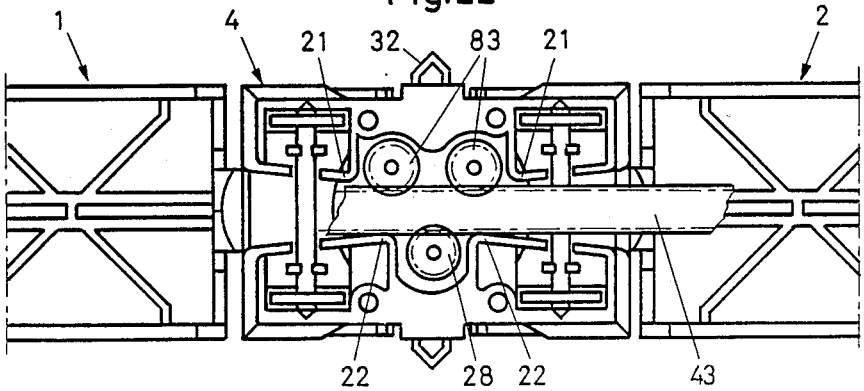
FIG. 22 Is a bottom plan view of a drive chassis in accordance with a further embodiment of the present invention.

In FIG. 22 an alternative embodiment of the driven chassis 4 is depicted. In this embodiment a pair of freely rotatable cog rollers 83 are provided opposite the drive cogwheel 28 to absorb the pressure exerted by the drive cogwheel 28. While the friction between the rack 43 is thus somewhat reduced with this embodiment it has the disadvantage of being somewhat more complicated to mount onto the track because of the cogwheels on both sides of the central section 43.

It should be understood at this point that the example of a toy cog railway train depicted in FIGS. 1–3 could readily be modified by using any desired combination of chassis and pivoted bogies with coupled cars and platforms. A further embodiment of an engine is depicted in FIGS. 23–34. Thus, the locomotive of FIG. 23 comprises a platform 85 to which a box-shaped cab is mounted. Two chassis 87, 88 are provided at the ends of the platform. Chassis 87 is driven and chassis 88 is free running. Both chassis include a coupling device 89. In accordance with the present invention, the locomotive is designed to operate on a track having on each side a smooth track face 90 and a center section containing a rack 91 as shown in FIG. 4. As will be described below, both the cab and the chassis are formed of interlocked building blocks.

Figure 24:
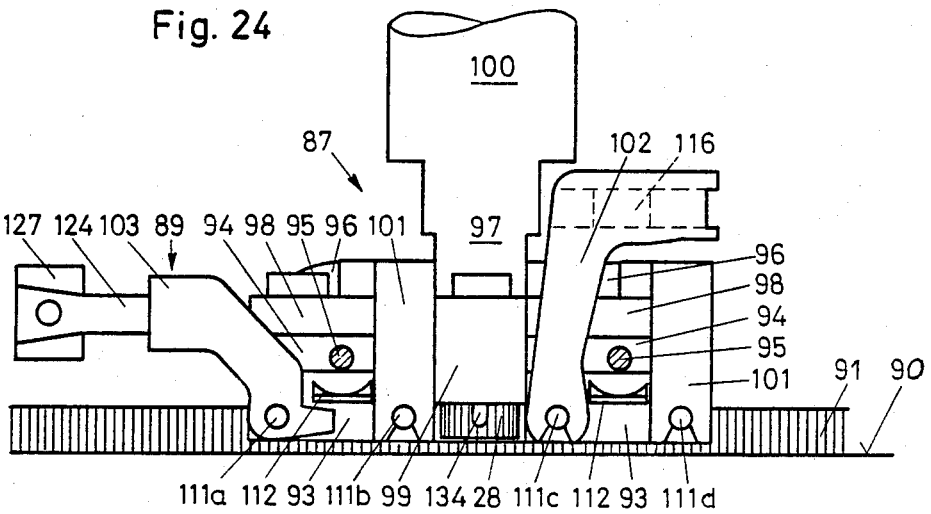
FIG. 24 is an enlarged side elevational view of the drive chassis of the locomotive of FIG. 23.
Figure 25:
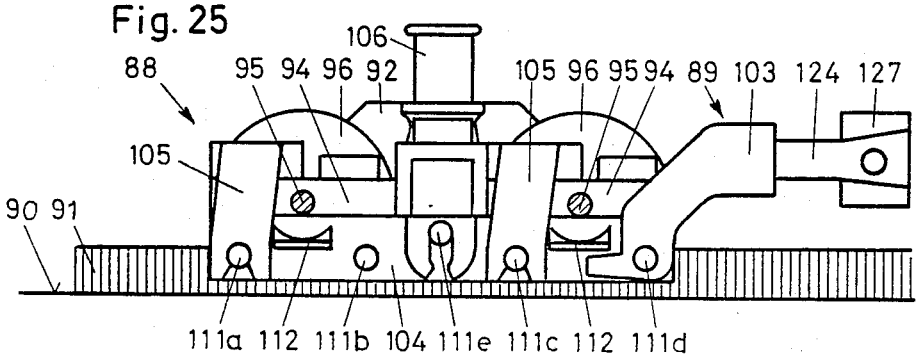
FIG. 25 is an enlarged side elevational view of the running chassis of the locomotive of FIG. 23.

FIGS. 24 and 25 depicted chassis 87 and 88 respectively with their wheels 96 and wheel cover plates 92 removed. The details of the components are depicted in FIGS. 26–30. Thus, the driven chassis 87 comprises:

a guiding and base building element 93 extending over the total length of chassis 87, element 93 serves as a guide for the chassis and as a base for the assembly of other building elements;

two mounting plates 94 are provided on base 93 and have openings for receiving wheel axles 95 on which wheels 96 are mounted, the wheels have smooth running faces for riding on the smooth driving faces 90 of the associated track;

a drive unit 97 mounted on mounting plates 94 which is provided with longitudinal plate parts 98, side plate parts 99, and an electromotor 100. The drive axle of the motor is provided with the drive cogwheel 28 designed to engage one of the racks 91 of the track center section;

two support yokes 101 are mounted to the drive unit 97 and the elements 93 to thereby hold together the elements 93, mounting plates 94 and drive unit 97 as a structural unit;

a connecting yoke pivoted on the base element 92 and used to rotatably connect the chassis 87 and the platform 85; and, coupling device 89 which contains a coupling yoke 103 pivoted to element 93 and arranged to couple the locomotive to another car.

The nondriven chassis 88 (FIG.25) is constructed in a similar fashion as the driven chassis and consists of the following elements:

a guiding and base element 104 corresponding to element 93;two mounting plates 94 are provided on base 93 and have openings for receiving wheel axles 95 on which wheels 96 are mounted, the wheels have smooth running faces for riding on the smooth driving faces 90 of the associated track; two support yokes 105 that hold together the elements 104 and mounting plates 94; a central pivot pin element 106 mounted on the element 104 and designed to be rotatably disposed in platform 85 of the locomotive; and, coupling device 89 which is pivoted on the element 104 and includes coupling yoke 93.

Figure 30:
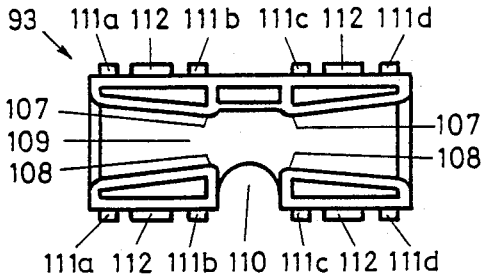
FIG. 30 is a bottom plan view of the guiding element of the drive chassis of FIG. 27.
Figure 33:
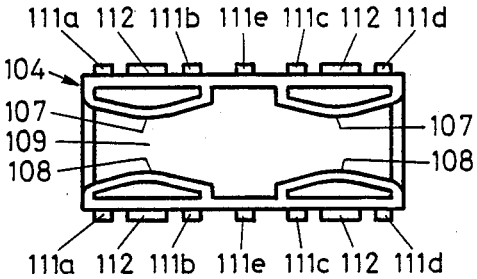
FIG. 33 is a bottom plan view of the guiding element of the running chassis of FIG. 29.

As previously discussed, the base building element 93 is provided on its upper face with an arrangement of coupling pins for the block building system and on its lower face with extended slide guiding walls 107, 108 and an intermediate space 109 designed to receive the central track section 91 as shown in FIG. 30. One longitudinal side of element 93 is provided with a recess 110 to receive the drive cogwheel 28. Both sides are provided with extended mounting pins 111*a*, 111*b*, 111*c* and 111*d* and protrussion 112 as shown in FIGS. 30 and 33.

Figure 23:
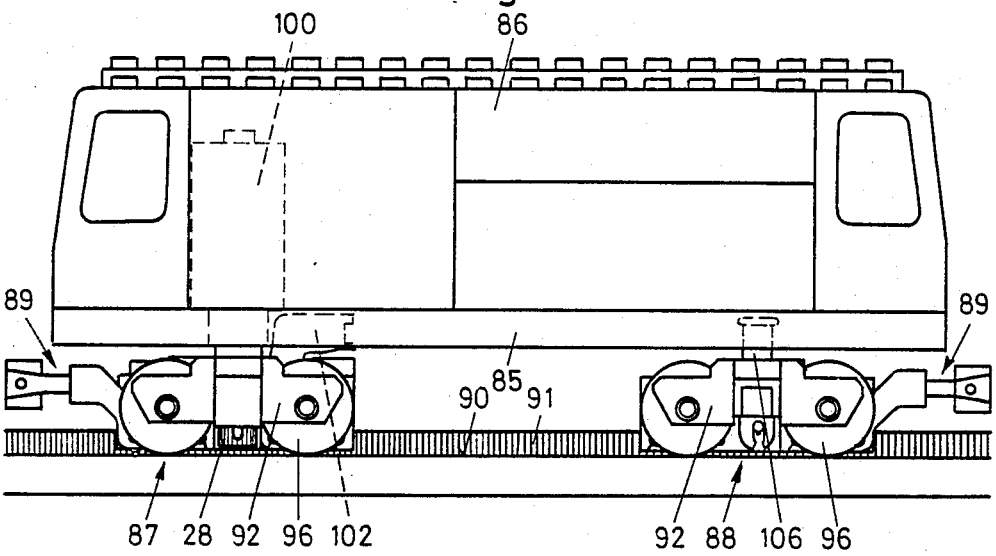
FIG. 23 is a side elevational view of a locomotive with two chassis.

Referring back to FIG. 24, the connecting yoke 102 and the coupling yoke 103 of the coupling device 89 are pivoted on element 93. To this end, the connecting yoke is provided with arms 113 each containing a clamping slot 114 which permit the arms to be attached to the inner mounting pins 111*c*. The yoke section is provided with a slot-like opening 115 provided with pin 116. The connecting yoke is used to pivotally connect the chassis 87 and platform 85 of the locomotive as depicted in FIG. 23. Rotation in the vertical direction is limited by the protrussions 112 which abut arms 113.

Coupling yoke 103 of device 89 is similar to yoke 102 and is provided with arms 117, 118 each having a hole 119 at their ends which permit the yoke to be inserted on the outer mounting pins 111*a* as shown in FIG. 24. Again vertical movement is limited by the extensions 120 of arms 117, 118 abutting protrussions 112.

The yoke portion of coupling yoke 103 is also provided with a slot like opening 121 provided with a pin 122. The opening and pin 122 receive a clamping flange 123 of yoke 124. Yoke 24 has two arms 125 each having a hole 126. A magnet support 127 including a permanent magnet 128 is secured by mounting pins 129 in holes 126. The pins permit the magnet support 127 to rotate between the arms 125 of yoke 124 so that the north pole of the magnet may be positioned opposite the south pole of the magnet of a similar coupling device to provide a magnetic coupling of the vehicles carrying the coupling yokes.

Figures 26, 27:
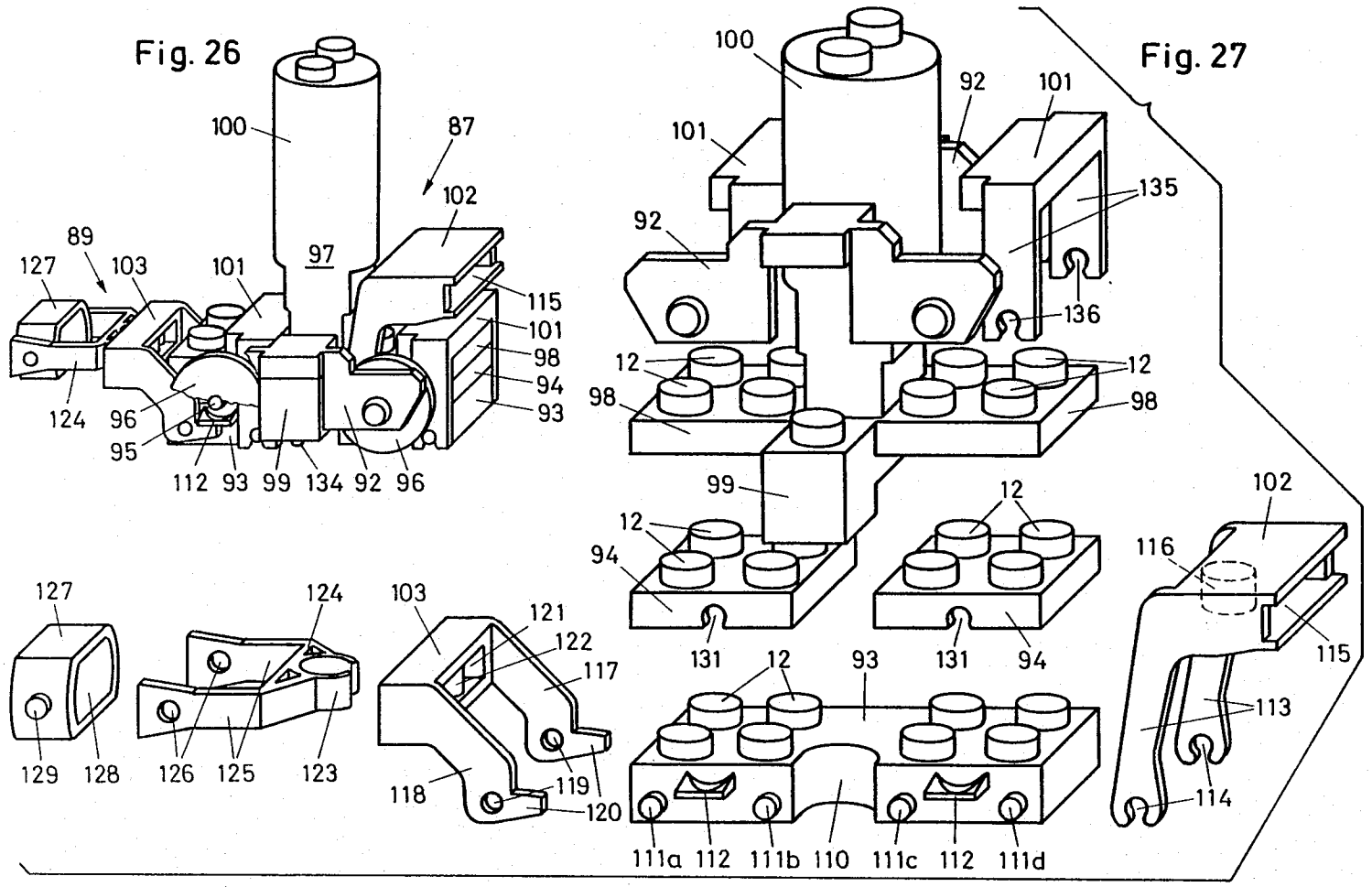
FIG. 26 is a perspective view of the drive chassis of FIG. 25.
FIG. 27 is an exploded perspective view of the drive chassis of FIG. 26.
Figure 31:
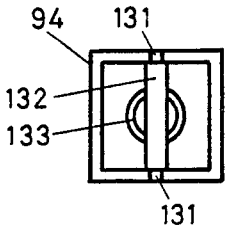
FIG. 31 is a bottom plan view of a mounting plate for rotating axles of the drive chassis of FIG. 27.
Figure 32:
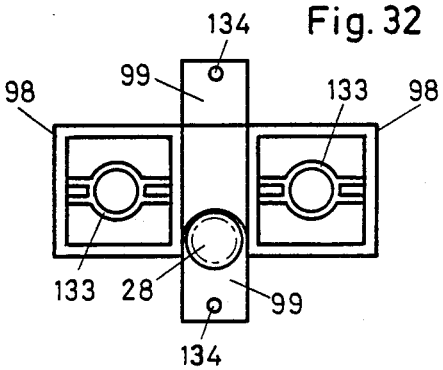
FIG. 32 is a bottom plan view of the drive block of the drive chassis of FIG. 27.

Referring to FIG. 27 it can be seen that coupling pins 12 of the base element 93 are used to connect the base to two mounting plates 94 which each contain clamping openings 131 for a wheel axle (not shown). As shown in FIG. 31 the underside of mounting plates 94 further include a groove-like recess 132 for the axle and a central extended tube 133 designed to counter couple with the coupling pins 12 of the block elements in a known fashion. The mounting plates 94 are also provided with coupling pins 12 on the upper face.

Referring to FIG. 26 it can be seen that the wheels 96 are mounted on the axles so as to be positioned laterally outwardly of their associated connecting yoke 102, 103.

Drive unit 97 is mounted to mounting plates 94 as shown in FIG. 24 with mounting plate parts 98, side plates 99 and the vertically extending motor 10. The outer faces of plate parts 98 and 99 are provided with coupling pins in the standard array. The undersides of plate parts 98 are similar to that of the mounting plates 94 except for the absence of the axle mountings. As can be seen, the drive cogwheel 28 of motor 100 extends between the side plates 99 so that the cogwheel is positioned in the recess 110 of element 93 (see FIG. 30). A pin 134 is provided in each of the side plates 99 movable in the longitudinal direction. The pins may be used to actuate switching elements (not shown) for controlling the current to the motor 100. As a result, by providing protrussions along the track to engage the pins control of the motor may be effected to alter the direction of or stop the train.

Two support yokes 101 (see FIG.24) are provided to hold the various elements together. The support yoke 101 may be connected to coupling pins 12 of the longitudinal plate parts 98 of the drive unit 97 and are locked onto the remaining pins **111*b* and 111*c* of element 93 by means of slots 136 provided in arms 135. Cover plate 92 is provided on each side of the assembly inserted into coupling pins 12 of the side plate 99 of drive unit 97**.

Figures 28, 29:
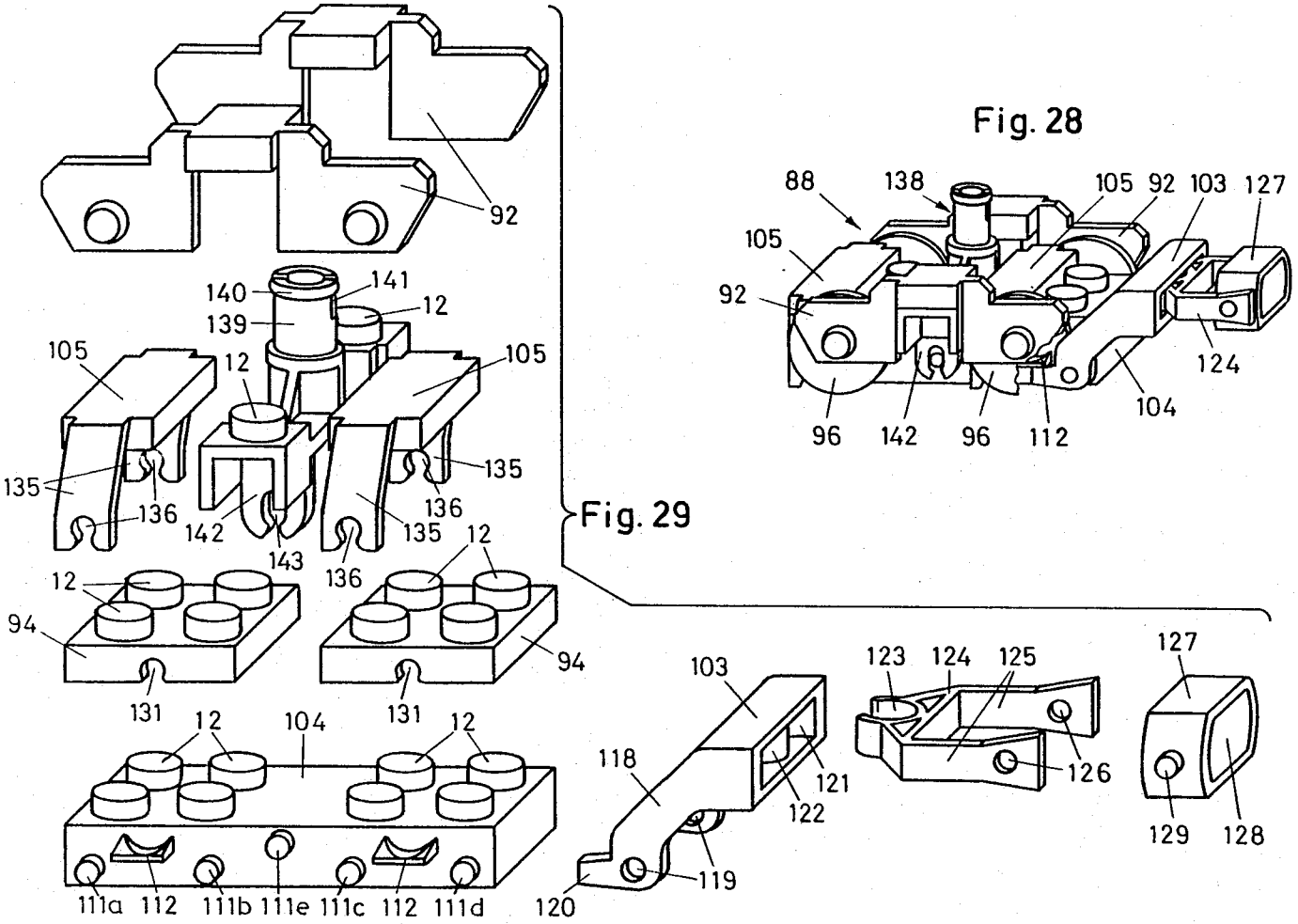
FIG. 28 is a perspective view of the running chassis of FIG. 25.
FIG. 29 is an exploded perspective view of the running chassis of FIG. 28.

The construction of the nondriven chassis of FIGS. 23 and 25 are depicted in detail in FIGS. 28 and 29. Thus, the running chassis 88 is provided with guiding and base element 10, the underside of which is shown in FIG. 33 and is substantially similar to that of the driven chassis except that it does not include a recess for receiving the cogwheel but Instead has a continuation of the longitudinal sidewalls and an additional mounting pin **111*e*. As can be seen in FIGS. 25, 28 and 29 coupling device 89 is pivotally mounted on element 104 through holes 119 of the coupling yoke 103 and mounting pins 111*d* as already described. Coupling yoke 103 includes yoke 124, magnet support 127 and permanent magnet 128**.

In place of the drive unit 97, the running chassis 88 is provided with a pivot mounting device 138 which includes a a pivot pin 139 provided with an upper shoulder 140 and includes longitudinal slots within the shoulder. Two downwardly directed extended flanges 142 (only one of which can be seen in FIG. 29) are provided at their ends with a slot 143 and flanges extend laterally from the tops of flanges 142 and each contains a coupling pin 12 on an upper face as shown. The pivot pin 138 is only slightly movable when mounted on base 104 by virtue of the flange slots engaging center mounting pins **111*e*. The wheel cover plates (FIG.29) are mounted to the coupling pins 12 of the pivot mounting means 138**.

Figure 34:
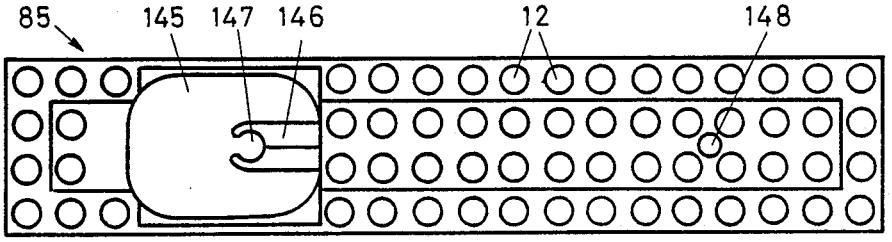
FIG. 34 is a top plan view of the platform of the engine of FIG. 23.

As shown in FIG. 34, the upper face of platform 85 is provided coupling pins 12 in a standard array for receiving blocks to form a car or a battery box for the motor. The platform is further provided with an opening 145 into which a flange 146 extends. The flange 146 is provided with a clamping slot 147 at its free end. The motor 100 is fed through opening 145 for mounting the chassis 87 onto platform 85. Slot 115 of connecting yoke 102 is applied to flange 146 until its clamping slot 147 locks on pin 166 (FIG. 27) of the connecting yoke 102. In this manner the chassis 87 is pivotally mounted onto platform 85. The center bore 148 permits rotation of the running chassis 88 with regard to platform 85. To this end, the pivot pin 139 of chassis 88 is inserted into this bore and retained by shoulder 140.

From FIGS. 24 and 25 it can be seen that the various force transmitting elements of the present cog railway, namely the connecting yoke 102 and the coupling device 89 on mounting pins **111*a*–111*d* are pivoted very close to the center of gravity-transverse plane on chassis 87 and 88** respectively to provide for great stability of the train up to the tilt limit.

Figure 35:
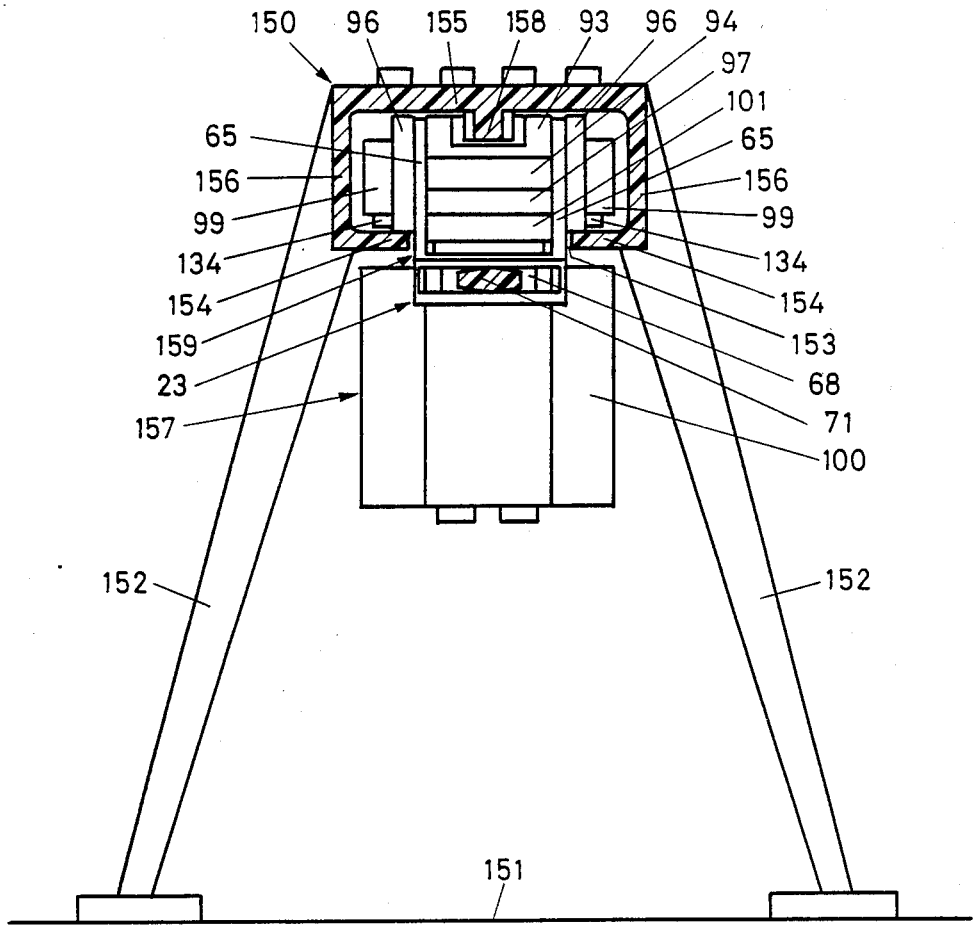
FIG. 35 is a view, partially in section, of the model cog railway of the present invention as a suspended railway.

The toy cog railway of the present invention may utilize tracks mounted on the ground, on ramps or suspended as shown in FIG. 35. Referring to FIG. 35 it can be seen that the track consists of a series of track sections 150 having generally box-like profiles open at their bottom face. The track sections are supported by posts 152 to support the track a desired height above the ground 151. Track piece 150 is provided with two legs 154 which a separated to define a lower opening 153. Yoke 155 is disposed opposite the opening with sides 156 connecting to yke 155 and the legs 154. The inner faces of the legs 154 provide driving faces for the wheels 96 of a vehicle 157. A center rack member 158 is provided on the inner face of yoke 155.

Vehicle 157 (which, in the exemplified embodiment comprises an engine) is provided with a driven chassis 159 similar to chassis 87 of FIGS. 26 and 27 modified to permit it to be suspended and therefore requiring a different coupling means. Thus, the chassis 159 is provided with the base element 93, mounting plates 94, wheels 96, drive unit 97, electromotor 100, side plates 99, control pins 134, coupling yoke 67 with arms 65 and a slot 68 for receiving tongue 71 of the coupled platform of a car as depicted in FIG. 35 and as previously described. An electromotor 100 has a driving axle extending vertically upwardly toward the inner face of yoke 155 supports a cogwheel (not shown) which is in contact with one of the racks of the center cogging member 158. Thus, it should be appreciated that the suspended railway of FIG. 35 operates as the train of FIG. 1 or FIG. 23. Since the wheels 96 of vehicle 157 are constrained within the box-like profile shape of track piece 150 the track piece may be mounted vertically or obliquely. In order to introduce the vehicle into the track must be provided with locations wherein the legs 154 are foldable or removable.

Other arrangements for the driving faces and cog racks of the track are depicted in FIGS. **36*a*–36*h*. For simplification, the driving faces of the track sections are designated by downwardly directed arrows and the cog racks are designated by a double line. Thus, FIG. 36*a*** represents the track configuration already discussed.

In FIG. **36*b*** the rack member is in a groove rather than being raised.

In FIG. **36*c*** the rack member as well as the driving faces are raised.

In FIG. **36*d*** the rack member as well as the driving faces are recessed.

Figure 36A:
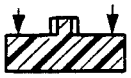
FIG. 36*a*–36*h* are sections through different embodiments of track members provided with cog racks.
Figure 36C:
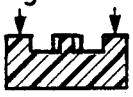
Figure 36E:
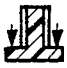

FIG. 36*e* is similar to FIG. 36*a* except that the driving faces are very small with respect to the height of the center member.

Figure 36G:
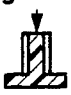
Figure 36B:
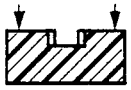
Figure 36D:
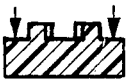
Figure 36F:
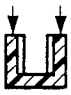
Figure 36H:
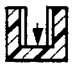

In FIG. 36*f* the rack members are in a deep groove.

FIGS. 36*g* and *h* illustrate respectfully a raised and a recessed single driving face with a two sided cog rack which is useful for a monorail or single wheel axle vehicle.

It should be appreciated that for each of the track embodiments the safe operation of the vehicle is assured by means of the slide or rolling guide member of the present invention which contacts both racks of the cogging member.

Figure 39:
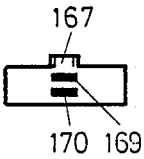

While the various embodiments of the invention have been shown with wheels engaging the driving faces of the track, it should be appreciated that sliding surfaces could be substituted for such wheels. In addition, while a battery has been shown as the power source it should be understood that this may be a conventional or rechargeable battery. Alternatively, it may be desirable to continuously feed power to the engine. An arrangement for doing this is depicted in FIGS. 37–39.

Figure 37:
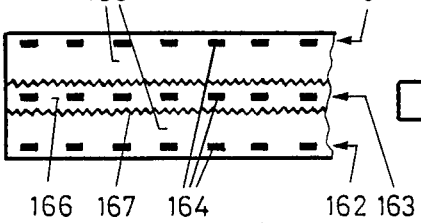
FIG. 37 is a top plan view of a section of track provided with racks in accordance with FIG. 4 and further provided with electric current feed contacts.
Figure 38:
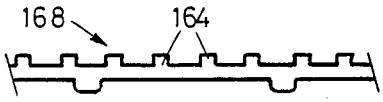
FIG. 38 is a side elevational view of a metallic contact for the track section of FIG. 37; and, FIG. 39 is a front elevational view of one end of the section of track of FIG. 37 with electrical contacts.

Thus, FIG.37 illustrates a piece of track such as previously illustrated in FIG. 4 in which three rows 161, 162, and 163 of contacts points 164 are disposed. The contact points 164 are raised slightly above the upper face 166 of the center rack section 167. The two outer rows of contacts 161 and 162 are mounted on the driving faces 165 of the track. The contacts on the driving faces are electrically connected to each other but separated from the row of contacts 163 on the rack member 167. The contacts may readily be formed as part of a metal tape 168 (see FIG. 38) anchored into suitable openings in the track section. Connection between track sections is made by yieldable contact pieces 169 and 170 mounted on the front face of each track section as shown in FIG. 39. One of the contact pieces is connected to the outer rows of contacts 161, 162 and the other is connected electrically to the center row of contacts 163. The connecting flanges 47 (see FIG. 8) which ensure a good mechanical interlock also ensures a good electrical connection between adjacent lengths of track.

While the present invention has been described in connection with the use of an electrically driven toy train, it should be appreciated that the train could also be driven by a spring mechanism, a flywheel or a gas or steam engine.

Having thus described the invention, what is claimed is:

1. A toy cog railway system having a train and an associated track, said track including at least one smooth driving face and a cogging member mounted along said driving face and extending perpendicularly to said driving face, said cogging member being provided with two teeth-bearing racks transversely spaced apart from each other, said racks being disposed symmetrically with respect to said driving face, the longitudinal direction of the teeth of said rack extending perpendicularly to said driving face, said at least one smooth driving face having the form of a flat strip;

said train including at least one vehicle in the form of an engine car, said engine car including at least two axles each having rimless wheels for running on said driving face, a drive motor in driving engagement with a cogwheel that engages said track cogging member, the rotating axis of said cogwheel extending perpendicularly to said axles, and means for guiding said engine car along said driving face includign at least one pair of opposed guide means formed to contact opposite sides of said cogging member, said cogwheel being laterally displaced with respect to the center line between said guide means so as to engage a single one of said racks; and means for coupling said engine car to a further vehicle, said coupling means being attached to said engine in the vicinity of said guide means.

2. The system in accordance with claim 1 wherein said train includes at least one further vehicle in the form of a nondriven car coupled to said engine car, said nondriven car equally including means for guiding said nondriven car along said driving face including at least one pair of opposed guide means formed to contact opposite sides of said cogging member.

3. The system in accordance with claim 2 wherein said further vehicle in the form of a nondriven car includes coupling means which are attached to said nondriven car in the vicinity of said guide means of said nondriven car.

4. The system in accordance with claim 1 wherein said track comprises two driving faces separated by said cogging member, said cogging member protruding above said driving faces.

5. The system in accordance with claim 1 wherein said cogging member is positioned in a groove between said driving faces, side faces of said groove being provided with said two racks transversely spaced apart from each other.

6. The system in accordance with claim 1 wherein said cogging member is elevated with respect to a track support, an upper smooth face of said cogging member forming a driving face for said train.

7. The system in accordance with claim 1 wherein said track is generally U-shaped in cross section and said cogging member racks are disposed on the inner faces of the legs of said U-shaped cross section, the inner bottom of said U-shaped cross section forming said driving face.

8. The system in accordance with claim 1 wherein said track has a box-like cross sectional shape formed of two opposed sides, a web extending across said sides and an open bottom defined by two legs extending towards each other, said cogging member extending downwardly from the center of said web and said driving face being disposed on the inner surfaces of said legs.

9. The system in accordance with claim 1 wherein said track has a box-like cross-sectional shape formed of two opposite sides, a web extending across said sides and an open bottom defined by two legs extending towards each other, said cogging member extending downwardly from the center of said web and said driving face being disposed on the inner face of said web.

10. The system in accordance with claim 1 wherein said driving face and said cogging member are formed from a single piece of synthetic plastic material.

11. The system in accordance with claim 1 wherein said track is formed of segments joined together by longitudinally extending flanges.

12. The system in accordance with claim 11 wherein said track includes at least one curved segment defining an arc of 45°, said curved segment having a major arcuate portion and a minor straight portion.

13. The system in accordance with claim 12 wherein said track includes two joined curved segments defining together an arc of 90° and the minor straight portions are disposed at the ends of said joined curved segments.

14. The system in accordance with claim 11 wherein each segment is provided with coding means in the form of recesses and protrusions at its end faces.

15. The system in accordance with claim 11 wherein each segment is provided with at least two rows of electrical contacts extending longitudinally there along, said rows forming electrical contacts for said engine car.

16. The system in accordance with claim 1 wherein said engine car includes a chassis to which said drive motor is mounted, said axles carrying the wheels being supported by said chassis.

17. The system in accordance with claim 16 wherein said coupling means includes at least one coupling yoke having two angled arms pivotally mounted to said chassis at a height approximate that of said cogwheel and in the longitudinal direction proximate to a vertical plane containing the center of gravity of the chassis.

18. The system in accordance with claim 16 wherein said chassis has exactly two axles.

19. The system in accordance with claim 16 wherein said chassis is formed of interconnected building blocks.

20. The system in accordance with claim 1 wherein said train includes at least one vehicle having a nondriven pivoted bogie including means for guiding said nondriven pivoted bogie along said driving face including at least one pair of guide means formed to contact opposite sides of said cogging member and including a coupling yoke having two angled arms pivotally mounted to said bogie at a height approximate that of said guide means and in the longitudinal direction proximate to a vertical plane containing the center of gravity of said bogie.

21. The system in accordance with claim 20 wherein said bogie includes a pivot pin and said vehicle includes a platform having means therein for receiving said pivot pin.

22. The system in accordance with claim 20 wherein said bogie has exactly two axles.

23. The system in accordance with claim 20 wherein said bogie is formed of interconnected building blocks.

24. The system in accordance with claim 17 or claim 20 wherein said coupling yoke is provided with a member connecting said arms and a slot positioned in said member and wherein at least one of said vehicles includes a platform having an elongated tongue member extending from an end thereof whereby said tongue member may be engaged in said slot to thereby couple said vehicle to said member.

25. The system in accordance with claim 24 wherein said tongue member is provided with a cam-like surface and said slot has a corresponding recess.

26. The system in accordance with claim 24 wherein said slot is rectangular and said tongue member has a rectangular cross-sectional shape whereby to preclude movement within said slot.

27. The system in accordance with claim 24 wherein said tongue member, in cross section has a shape different from that of said slot whereby to permit limited rotational movement of said tongue member within said slot.

28. The system in accordance with claim 24 wherein said coupling yoke further includes a rotatable magnet mounted to said member connecting said arms.

29. A track for a toy cog wheel railway, said track including at least one smooth driving face and a cogging member mounted along said driving face and extending perpendicularly to said driving face, said cogging member being provided with two racks transversely spaced apart from each other, said racks being disposed symmetrically with respect to said driving face, the longitudinal direction of the teeth of said racks extending perpendicularly to said driving face, and said at least one smooth driving face having the form of a flat strip.

30. An engine for a toy cog wheel railway, said engine including at least two axles each having rimless wheels, a drive motor in engagement with a cogwheel for engaging a track cogging member having a pair of racks on opposite sides thereof, the rotating axis of said cogwheel extending perpendicularly to said axles, and means for guiding said engine along a driving face of said track including at least one pair of opposed guide means formed to contact sides of said cogging member, said cogwheel being laterally displaced with respect to the center line between said guide means so as to engage a single one of said racks.

31. The engine in accordance with claim 30 wherein said engine includes a chassis supporting said drive motor and means for coupling said engine to another vehicle, said coupling means including a coupling yoke having two angled arms pivotally mounted to said chassis at a height approximate that of the cogwheel and in the longitudinal direction approximate that of a vertical plane containing the center of gravity of said chassis.

* * * * *